United States Patent [19]

Fujishiro

[11] 4,218,972

[45] Aug. 26, 1980

[54] SWITCHING APPARATUS BETWEEN PRINTING MODES IN PRINTING CYLINDERS OF ROTARY PRESS

[75] Inventor: Yuji Fujishiro, Tokyo, Japan

[73] Assignee: Kabushiki Kaisha Tokyo Kikai Seisakusho, Tokyo, Japan

[21] Appl. No.: 19,876

[22] Filed: Mar. 12, 1979

[30] Foreign Application Priority Data

Feb. 2, 1979 [JP] Japan ..... 54-11245

[51] Int. Cl.[3] ..... B41F 7/10; B41F 7/12; B41F 13/28

[52] U.S. Cl. ..... 101/177; 101/180; 101/182; 101/184; 101/218

[58] Field of Search ..... 101/178, 179, 180, 181, 101/182–185, 176, 177, 217, 218, 247, 137, 138, 139, 140, 142, 143, 144, 145

[56] References Cited

U.S. PATENT DOCUMENTS 3,329,086 7/1967 Pullen ..... 101/82

FOREIGN PATENT DOCUMENTS 1815456 7/1969 Fed. Rep. of Germany ..... 101/179
2409219 9/1975 Fed. Rep. of Germany ..... 101/179
1257552 5/1959 France ..... 101/220
1158470 7/1969 United Kingdom ..... 101/218

*Primary Examiner*—J. Reed Fisher

[57] ABSTRACT

In a mechanism for selectively obtaining two extreme positions of printing cylinders, i.e. a contact of four cylinders except an impression cylinder and a contact of five cylinders including the impression cylinder, through effecting angular displacements of eccentric sleeves attached to respective printing cylinders simultaneously by a common link mechanism, an angle increase shifting mechanism is interposed between the starting end of the link mechanism and the end of an actuator. Whereby, the pair of printing cylinders can be directly shifted from one to the other extreme positions by a single stroke of the actuator.

A member attached to a main shaft of the angle increase shifting mechanism is divided into three pieces of a front piece, center piece and a rear piece, and the center piece is adapted to be selected engaged by and disengaged from the front and rear pieces by means of a pin clutch mechanism. Whereby, the shifting to the intermediate mode is possible independently and branchingly from either of the two extreme positions after completion of the switching to either positions.

3 Claims, 18 Drawing Figures

SWITCHING APPARATUS BETWEEN PRINTING MODES IN PRINTING CYLINDERS OF ROTARY PRESS

BACKGROUND OF THE INVENTION

The present invention relates to an apparatus for shifting a pair of printing cylinders mutually and relatively to the other, when the printing mode is switched from one printing mode to the other printing mode, in a rotary press adapted to perform printings of a plurality of different printing modes. Further, for a rotary press in which an intermediate mode, i.e. an impression throw off, is required, the invention relates to an apparatus of the kind described and capable of allowing a branching to such an intermediate mode.

The rotary presses capable of performing a plurality of printing modes to which the present invention is applied are:

(1) a rotary press capable of performing both of relief printing and relief offset printing (See FIGS. 1 to 3) and (2) an offset rotary press capable of performing both of satelite design printing and BB (blanket to blanket design) printing (See FIGS. 4 and 5).

These presses have the following common basic arrangement of cylinders. Namely, among the five cylinders including two plate cylinders 16 and 17, two printing or blanket cylinders 18 and 19, and one impression cylinder 20, the two plate cylinders 16 and 17 and the impression cylinder 20 are disposed at positions corresponding to apices of an equilateral triangle, and the blanket cylinders 18 and 19 are disposed between the impression cylinder 20 and the plate cylinders 16 and 17, respectively. It is possible to perform printings of a plurality of different printing modes, by bringing two blanket cylinders 18 and 19 into and out of contact with each other and with other cylinders 16, 17 and 20. The present invention is concerned with an apparatus for effecting the shifting and switching of these two printing cylinders 18 and 19 relatively to each other and to other cylinders.

The relationship between the positions of the cylinders and the printing modes from the view points of positions of two printing cylinders is as follows.

In the arrangement as shown in FIG. 1, the blanket cylinders 18 and 19 are in contact with the plate cylinders 16 and 17, respectively. The blanket cylinders are not in contact with each other. The impression cylinder 20 has been moved upward away from the blanket cylinders. This arrangement is for a relief printing. A monochromatic printing on both sides of paper and a double color printing on single side can be achieved by the paths of webs W1 and W2.

The arrangement as shown in FIG. 2 is substantially identical to that of FIG. 1 but the impression cylinder 20 has been moved downward into contact with the blanket cylinders. This arrangement is for a relief offset printing. A doubl color printing on single side of paper is performed with a path of web W3.

The arrangement as shown in FIG. 3 is characterized in that the blanket cylinders 18 and 19 are in contact with each other but are not of contact with the impression cylinder 20. This arrangement is for a relief offset printing. A monochromatic printing on one side of the paper is effected with a path of web W4.

FIG. 4 shows the arrangement of the printing cylinders in relation to other cylinders adopted when the printing machine is used for B-B offset printing, i.e. the same arrangement as that shown in FIG. 3. The path of web W5 is strictly identical to that W4 as shown in FIG. 3, and affords a monochromatic printing on both sides. Further, it is possible to effect a monochromatic printing on one side and double color printing on the other side, by bringing a third blanket cylinder 60 into contact with the impression cylinder 20 and a third plate cylinder 61 into contact with the third blanket cylinder 60, with a path of web W6.

FIG. 5 shows the arrangement of printing cylinders in relation to other cylinders, i.e. the same arrangement as that of FIG. 2, adopted when the printing machine is used for a satelite design offset printing. It is possible to effect a tricolor printing on one side with a path of web W7, by adding a third blanket cylinder 60 and a third plate cylinder 61 to the arrangement as shown in FIG. 2, as in the case of arrangement shown in FIG. 4.

From a view point of movements of printing cylinders, i.e. the blanket cylinders 18 and 19, the arrangement as shown in FIG. 1 is identical to that of FIG. 2, while the arrangement as shown in FIG. 5 is identical to that of FIG. 2. At the same time, the arrangement as shown in FIG. 4 is identical to that of FIG. 3, from the same point of view. Thus, the relative positions of the printing cylinders between which these cylinders are switched by the apparatus of the invention are the first position as shown in FIGS. 1, 2 and 5 and the second position as shown in FIGS. 3 and 4. In case of the B-B printing (FIG. 4) and the satelite design printing (FIG. 5), it is necessary to take a intermediate mode, i.e. a state of impression throw off as shown in FIG. 8. However, no impression throw off is required in the switching between the relief printing (FIG. 1) and relief offset printing (FIG. 2), and other relief offset printing (FIG. 3).

The above stated technical subject of switching of printing cylinders has been achieved conventionally by a method in which the shifting of the printing cylinders from one to the other positions is made via the intermediate mode, i.e. the state of impression throw off as shown in FIG. 8. This inconveniently requires two reciprocating motions of the actuator, as well as a conversion of fulcrum of power transmitting link at the intermediate mode. As a result, the conventional system requires a troublesome operation which may incur an error. It is considered that the above-stated conventional solution has been adopted because of the difficulty in achieving the large angular displacement of the eccentric sleeves required for the directly shifting of the printing cylinders only by one stroke of the actuator.

It is therefore an object of the invention to create and provide a switching apparatus between printing modes in printing cylinders of rotary press, in which the large angular displacements of eccentric sleeves, which is required for directly shifting the pair of printing cylinders from one to the other positions, can be effected safely, promptly and easily by a single stroke of actuator, thereby to overcome above stated problem of the prior art.

It is another object of the invention to create and provide a switching apparatus between printing modes in printing cylinders of rotary press, in which the intermediate mode, i.e. the impression throw off is provided not merely as a relaying position in the switching between one position and other position of the printing cylinders, but, rather, the switching to the intermediate mode is possible independently and branchingly from either of the first and second modes, after completion of the switching to either mode, so that it is possible to reset the cylinders to the cylinder arrangement under the use safely, promptly and easily, after the completion of the work which requires a shifting to the impression throw off.

SUMMARY OF THE INVENTION

Briefly, in order to achieve the first object of the invention, there is provided a mechanism for selectively obtaining two extreme positions of printing cylinders, i.e. a contact of four cylinders except the impression cylinder and contact of five cylinders including the impression cylinder, through effecting angular displacements of eccentric sleeves attached to respective printing cylinders simultaneously by a common link mechanism, characterized by comprising an angle increase shifting mechanism interposed between the starting end of the link mechanism and the end of the piston rod of the actuator. Further, in order to achieve the first and second objects, there is provided a mechanism of the kind described above, in which a member attached to a main shaft of the angle increase mechanism is divided into three pieces of a front piece, center piece and a rear piece, the center piece being adapted to be selected engaged by and disengaged from the front and rear pieces by means of a pin clutch mechanism.

BRIEF DESCRIPTION OF THE DRAWINGS

FIGS. 1 to 5 show various printing modes which can be attained by the use of a switching apparatus of the invention in which:

FIG. 1 is an illustration of the positional relationship between the printing cylinders and other cylinders, adopted when the rotary press is used for a relief printing (two-side monochromatic or single-side two color printing), FIG. 2 is an illustration of the positional relationship between the printing cylinders and other cylinders, adopted when the rotary press is used for a relief offset printing (single-side two-color printing), FIG. 3 is an illustration of the positional relationship between the printing cylinders and other cylinders adopted when the rotary press is used for a relief offset printing (Two-side monochromatic printing), FIG. 4 is an illustration of the positional relationship between the printing cylinders and other cylinders, adopted when the rotary press is used for a B-B design offset printing (two-side monochromatic or single-side two-color printing), FIG. 5 is an illustration of the positional relationship between the printing cylinders and other cylinders, adopted when the rotary press is used for a satellite design offset printing (single-side tricolor printing)

FIGS. 13 and 14 show the positional relationship of the essential parts of cylinder shifting mechanism in the state as shown in FIG. 6, while FIGS. 14 and 16 show the same in the state as shown in FIG. 7, and FIGS. 17 and 18 show the positional relationship of essential parts of the shifting mechanism in the state of impression throw off of the printing cylinders, in which FIG. 17 shows the positional relationship of the essential parts taken when the impression throw off of the printing cylinders is started from the printing mode as shown in FIG. 6, i.e. the printing mode as shown in FIGS. 13 and 15, while

DESCRIPTION OF THE PREFERRED EMBODIMENT

Figure 1:
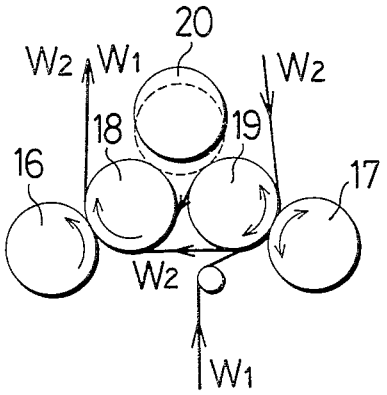

Hereinafter, the invention will be more fully described through a specific embodiment with reference to the accompanying drawings.

The description will be started first with the explanation of a conventional eccentric mechanism and the link mechanism for driving the eccentric mechanism. Referring to FIGS. 6, 7, 9 and 10, two blanket cylinders 18 and 19 are both supported by eccentric sleeves 21 and 22, respectively. Brackets 23 and 24 are extended from respective eccentric sleeves 21 and 22. A pair of links 25 and 26 are supported at their one ends on respective brackets by means of pivots 27 and 28. One of these links 25, 26 is pivoted at its other end to a connecting piece 29 by a pivot 30, while the other link is fixedly connected at its other end to the same connecting piece. A dog-leg-shaped link 32 is pivoted to a pivot 31 which is provided also on the connecting piece 29.

Figure 6:
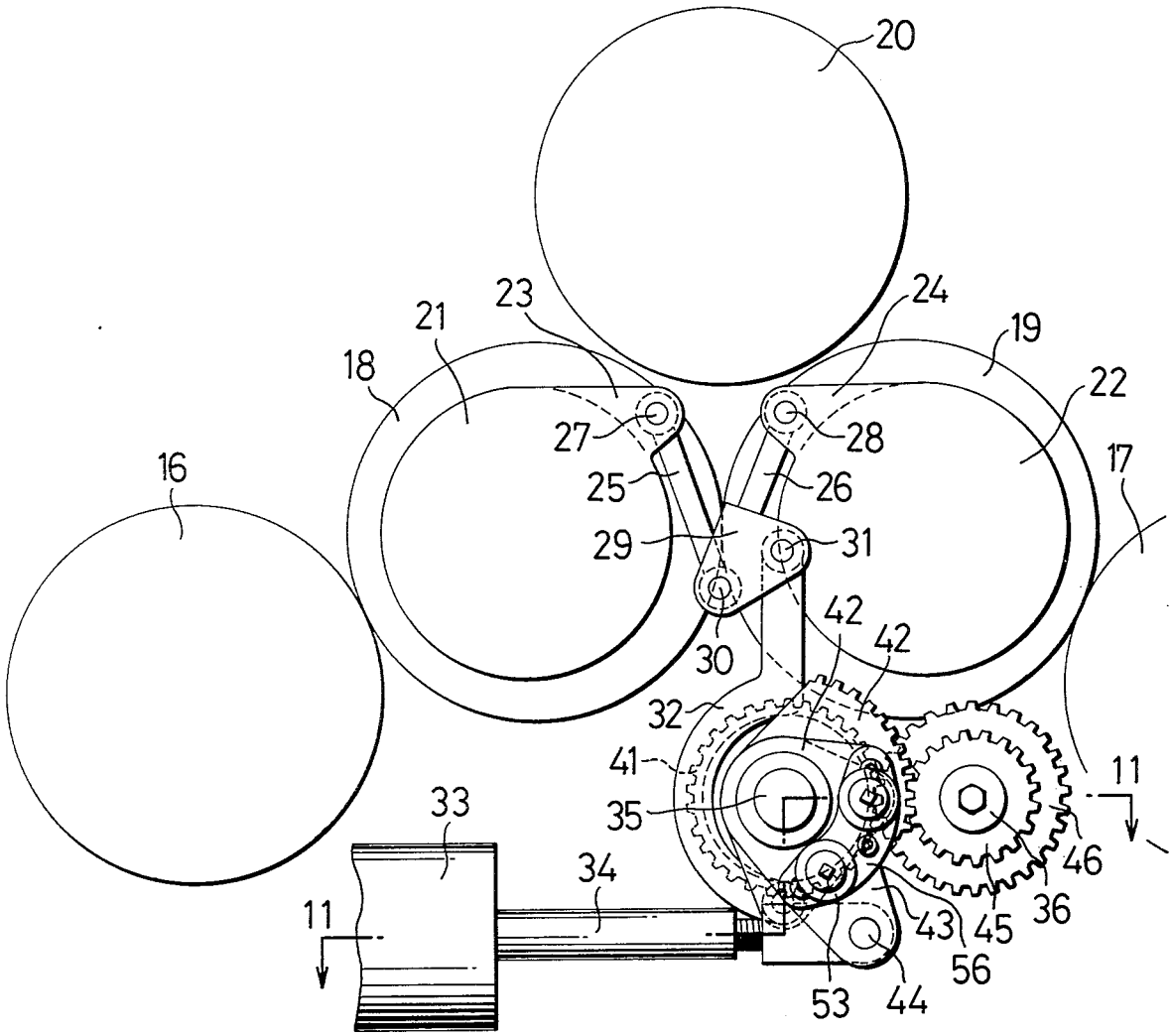
FIG. 6 is a perspective view showing the positional relation of essential parts of a printing-cylinder shifting mechanism in the printing modes as shown in FIGS. 3 and 4.

As shown in FIG. 6, as the dog-leg-shaped link 32 is pulled to one extreme position, the pair of links 25 and 26 are moved to each other to form a V-shape, and the pair of eccentric sleeves 21 and 22 are rotated in the opposite directions by an equal angle. As a result, the blanket cylinders 18 and 19 are made to contact each other, thus achieving the connection of four cylinders 16, 18, 19 and 17 except the impression cylinder 20.

On the other hand, as the dog-leg-shaped link 32 is moved to the other extreme position, the pair of links 25 and 26 are moved away from each other to extend linearly, and the pair of eccentric sleeves 21 and 22 are rotated in the opposite directions by an equal angle, so that the blanket cylinders 18 and 19 are moved away from each other. As a result, the connection of five cylinders 16, 18, 20, 19 and 17 is achieved.

The movement of the dog-leg-shaped link 32 is caused by the piston rod 34 of an actuator 33. However, it is difficult to cause a large angular displacement of the eccentric sleeves 21, 22 between one extreme position (See FIG. 6) and the other extreme position (See FIG. 7) at once by a single stroke of the small pneumatic cylinder 33, if the starting end of the link 32 is merely connected to the end of the rod 34 in an ordinary way.

According to the invention, this problem has been overcome by providing a geared angle increase shifting mechanism between the starting end of the link 32 and the end of the rod 34.

Figure 11:
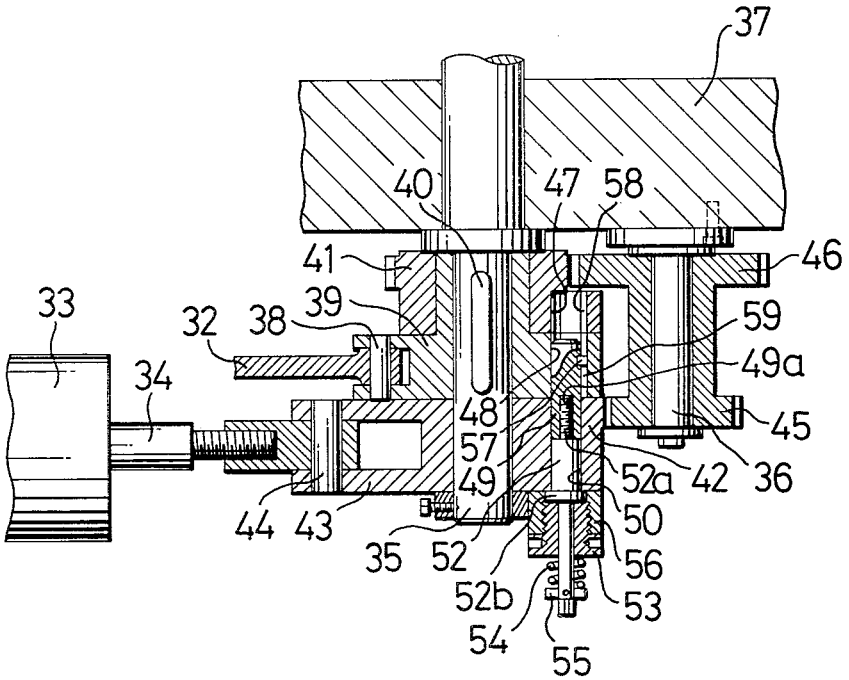
FIG. 11 is a sectional plan view taken along the line 11—11 of FIG. 6, showing a clutch pin shifted to a position where it permits the impression throw off of the printing cylinders.
Figure 12:
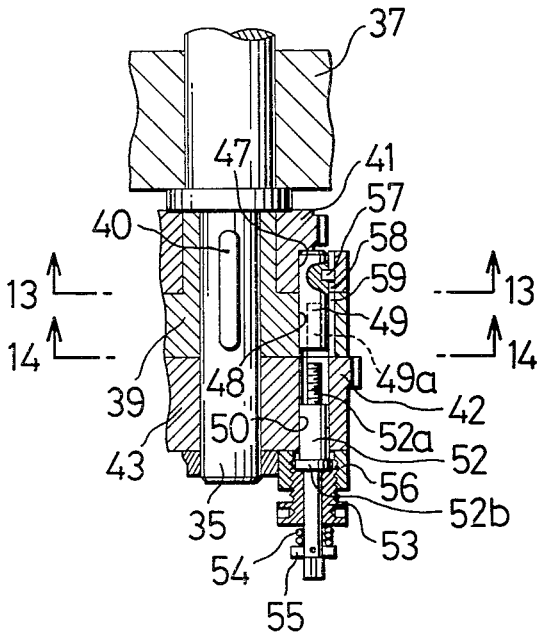
FIG. 12 is a sectional plan view of an essential part of FIG. 11, showing the clutch pin shifted to a position where it permits the switching of the printing mode.

As shown in FIGS. 11 and 12, the main shaft 35 of the angle increase mechanism extends through the operating side of a side frame 37, and rotatably supported by the latter. The main shaft 35 further extends through and supported by the other side frame which is not shown, so as to cause the angle increase shift of the other link mechanism which has been neglected in the drawings. A sub shaft 36 is fixed to the outer surface of the side frame 37, by means of screws.

The starting end of the link 32 is connected to one apex of a triangular driven disc 39, through a pivot 38. The driven disc 39 is supported at its center to the main shaft 35 by means of a key 40. The arrangement is such that the angular displacement of the driven disc 39 is transmitted to the main shaft 35 through the key 40 and then to the driven disc of opposite side which is not shown to impart the same angular displacement to the latter.

Between the driven disc 39 and the side frame 37, disposed is a driven gear 41 which is rotatable around the axis of the shaft 35. In the illustrated embodiment, the driven disc 39 and the driven gear 41 are provided separately for independent angular movement, so as to afford the intermediate mode, i.e. the impression throw off. However, if such an intermediate mode is not necessary, they may be constructed unitarily with each other.

A prime mover segment gear 42 rotatable relatively to the main shaft 35 is attached to the outside of the driven disc 39. An arm 43 unitary with the segment gear 42 is extended at an angle of about 90° to the main shaft 35. The end of the arm 43 is pivoted by a pivot 44 to the corresponding end of the piston rod 34 of the air cylinder 33.

Two relay gears 45, 46 unitary with each other are mounted on the sub shaft 36 for free rotation relatively to the latter. These relay gears have different diameters. The smaller and larger gears 45 and 46 are engaged by the prime mover segment gear 42 and the driven gear 41, respectively.

If the driven disc 39 and the driven gear 41 are made unitary, and if the ratio of rotation of the prime mover segment gear 42 to the driven gear 41 is selected to be 1:2, an angular displacement which is two times as large as that of the prime mover segment gear 42 is imparted to the driven disc 39. Consequently, a displacement which is two times as large as that of the stroke of the rod 34 of the pneumatic cylinder 33 is given to the dig-leg-shaped link 32. Needless to say, a displacement three times as large as that of the stroke of rod 34 can be obtained by selecting the rotation ratio to be 1:3.

Figure 8:
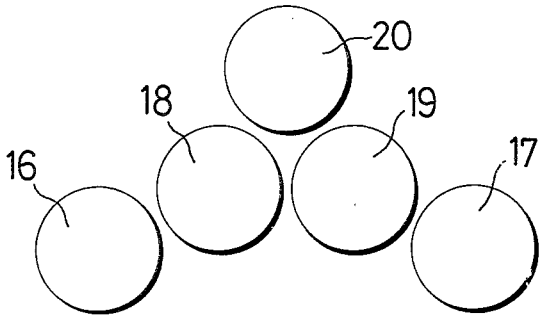
FIG. 8 is an illustration of printing cylinders in the state of impression throw off, in the printing modes as shown in FIGS. 4 and 5, in relation to other cylinders.

According to the invention, the blanket cylinders 18 and 19 are adapted to take, in addition to both extreme positions, an intermediate mode, i.e. a state of impression throw off as shown in FIG. 8 in which the blanket cylinders 18 and 19 are kept out of contact with all other cylinders. This is achieved by a pin clutch mechanism as described below.

Referring to FIGS. 11 to 15, bores 47 and 48 are formed in the driven gear 41 and the driven disc 39, respectively. With these bores aligned with each other, a common clutch pin 49 is inserted into both bores as shown in FIG. 12. As a result, the driven gear 41 and the driven disc 39 are connected unitarily to each other, so that the angular displacement which is, for example, two times as large as that of the driven gear 41 is directly transmitted to the disc 39. As the clutch pin 49 is withdrawn from the bore 48 of the driven disc 39 as shown in FIG. 11, the angular displacement of, for example, two times that of the driven gear 41 is not transmitted to the driven disc 39.

Insteadly, when the driven disc 39 and the driven gear 41 are not connected to each other, the same angular displacement as that of the prime mover segment gear 42 is transmitted directly to the driven disc 39, if the clutch pin 49 is operated so as to unitarize the driven disc 39 and the prime mover segment gear 42 with each other, as shown in FIG. 11. As a result, the displacement of the dog-leg-shaped link 32 connected to the driven disc 39 is reduced to a half of that obtained by the above-described engagement. It is therefore possible to set the pair of blanket cylinders 18 and 19 at the intermediate mode as shown in FIG. 8.

Figure 13:
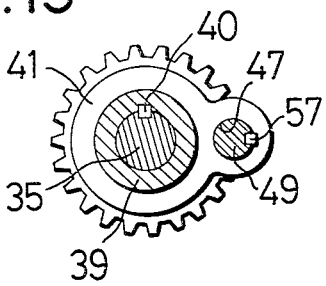
FIGS. 13 and 14 are longitudinal sectional views taken along the line 13—13 of FIG. 12, FIGS. 15 and 16 are longitudinal sectional views taken along the line 14—14 of FIG. 12, where
Figure 14:
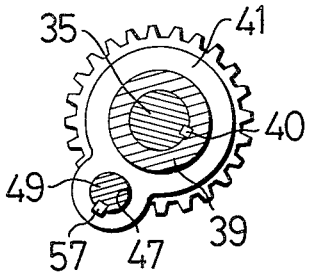
Figure 15:
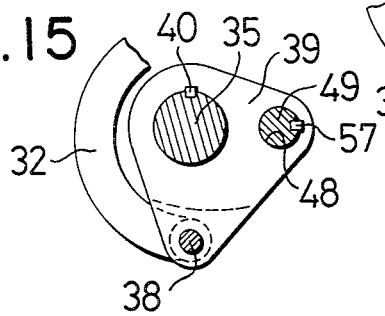
Figure 16:
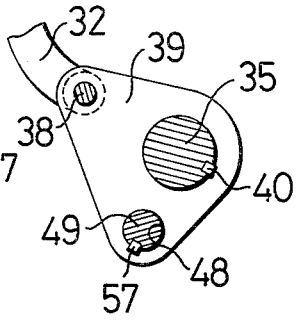

For a convenience's sake of explanation, it is assumed here that the ratio of rotation of the prime mover segment gear 42 to the driven gear 41 is 1:2. Also, an assumption is made that the stroke length of the piston rod 34 of the pneumatic cylinder 33 corresponds to an angular displacement of 60° of rotation around the axis of the main shaft 35. In such a case, the driven gear 41 is rotated by 120° from the position as shown in FIG. 13 to the position as shown in FIG. 14, by a single stroke of the rod 34. Then, the driven disc 39 which has been made unitary with the driven gear 41 by the insertion of the clutch pin 49 is rotated also by 120° from the position as shown in FIG. 15 to the position as shown in FIG. 16. In the course of this displacement, however, prime mover segment gear 42 is rotated only by a half of the above stated angular displacement, i.e. only by 60°. Thus, a phase differential of 60° is caused between the rotation of the driven gear 41 and the prime mover segment gear 42, for one stroke of the rod 34.

Figure 7:
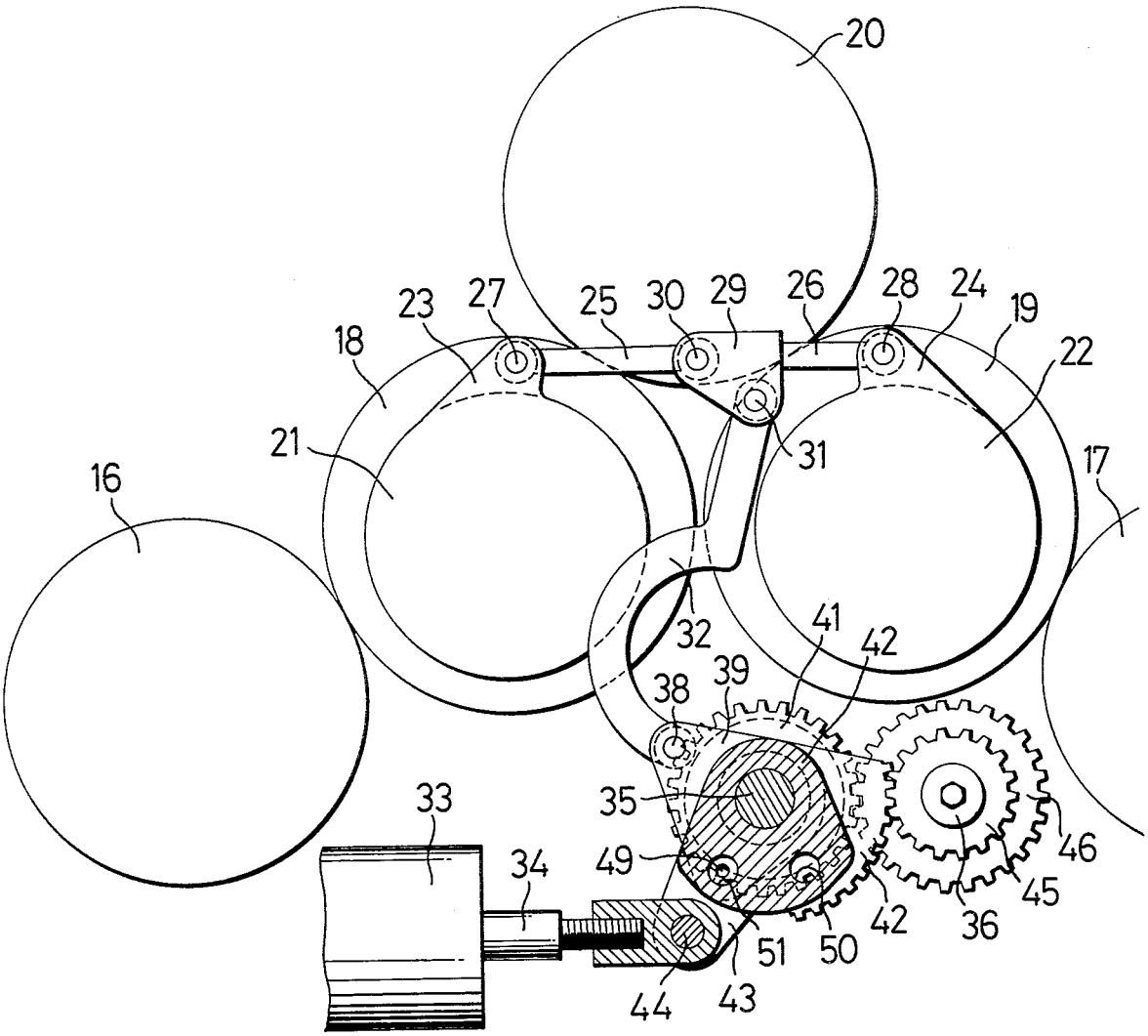
FIG. 7 is a perspective view showing the positional relationship of essential parts of a printing-cylinder shifting mechanism in the printing modes as shown in FIGS. 1, 2 and 5.
Figure 10:
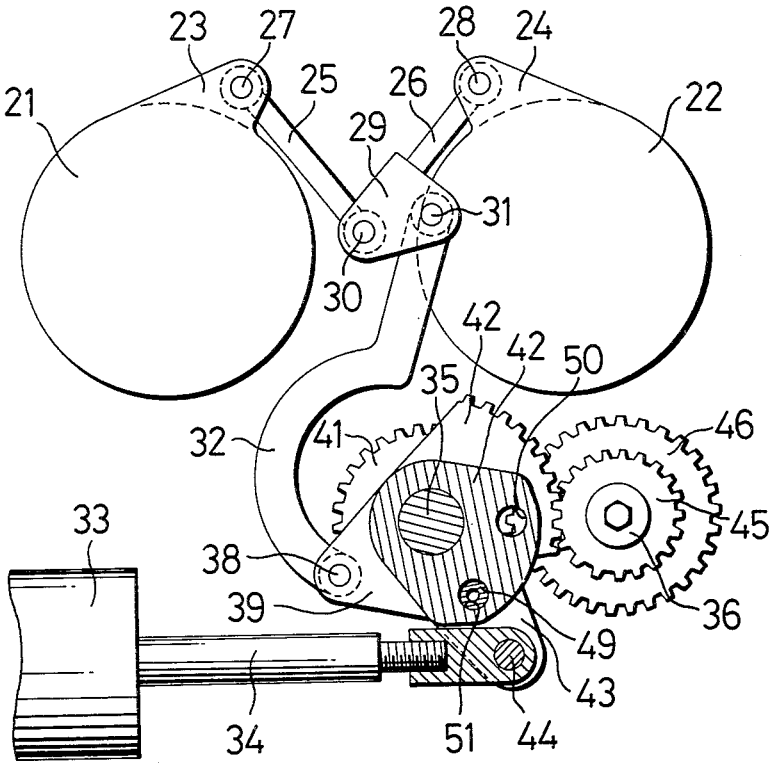
FIG. 10 is a partly sectioned longitudinal sectional view, showing the positional relationship of essential parts of the shifting mechanism, in which the throw off of the printing cylinders is effected from the states as shown in FIGS. 1, 2, 5 and 7.

For this reason, as will be seen from FIGS. 7 and 10, bores 50 and 51 for receiving the clutch pin 49 are formed in the prime mover segment gear 42 at angular difference of 60° around the axis of the main shaft 35. More specifically, one 50 of the bore is positioned to align with the clutch pin insertion bores 47 and 48 of the driven gear 41 and the driven disc 39, when these gear and disc are positioned as shown in FIGS. 13 and 15, respectively, while the other bore 51 is adapted to align with the pin insertion bores 47 and 48, when the driven gear 41 and the driven disc 39 are positioned as shown in FIGS. 14 and 16.

At the outer ends of the pair of clutch pin insertion bores 50 and 51 provided in the prime mover segment gear 42 are provided an operative mechanism for longitudinally actuating the clutch pin 49. FIGS. 11 and 12 show only one of these mechanism located closer to the insertion bore 50. The other of the mechanisms is neglected from the drawings, because it has a construction strictly identical with the illustrated one.

Referring to FIGS. 11 and 12, a clutch pin operating rod 52 is received by the bore 50. A male screw rod 52*a* is formed at the end of the rod 52. The male screw rod 52*a* is adapted to be screwed into a female screwed bore 49*a* formed in the clutch pin 49 in the longitudinal direction of the latter. A flange 52*b* of a diameter larger than that of the bore 50 is formed at the intermediate portion of the operating rod 52. A sleeve 53, a coiled spring 54 and a spring retainer 55 are attached in the mentioned order to the head of the operation rod 52. The sleeve 53 is threaded at its outer peripheral surface for engagement with an internal threaded bore of an arc-shaped plate 56 which is fixed by bolts along the outer surface of the bores of the segment gear 42, whereby the clutch pin actuating mechanism as a whole is attached to the opening of the bore 50.

On the other hand, since any rotation of the clutch pin 49 during the operation causes an operation failure, the clutch pin 49 is provided with means for allowing only the longitudinal movement thereof but preventing the rotation of the same. Namely, a rotation prevention pin 57 for preventing the rotation of the clutch pin 49 is extended laterally from the pin 49 and is received and guided by guided grooves 58 and 59 which are formed in the inner walls of the bores 47 and 48 in the longitudinal direction of the latter.

The apparatus of the invention having the described construction operates in the following manner.

Figure 2:
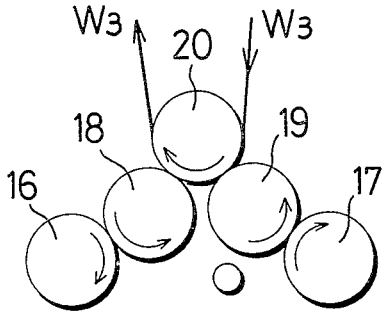
Figure 3:
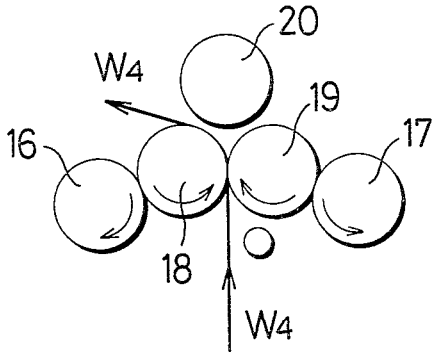

In case of the printing modes in which the printing throw off is not necessary (See FIGS. 1, 2 and 3), it is not necessary to provide the pin clutch mechanism, and the driven gear 41 and the driven disc 39 can be formed unitarily with each other. The switching between the first extreme position in which, as shown in FIG. 6, four cylinders 16, 18, 19 and 17 except the impression cylinder 20 are connected, and the second extreme position in which, as shown in FIG. 7, five cylinders including the impression cylinder 20 are connected, is effected by one stroke of operation of the rod 34 of pneumatic cylinder 33 between the fully extended position (See FIG. 6) and the fully retracted position (See FIG. 7). This single motion is doubled by the angle doubling shifting machanism and transmitted to the dog-leg-shaped link 32, so as to drive both blanket cylinders 18 and 19 directly from their one extreme positions to the other extreme positions.

Figure 4:
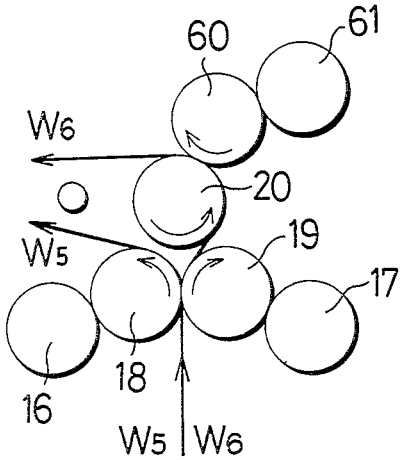
Figure 5:
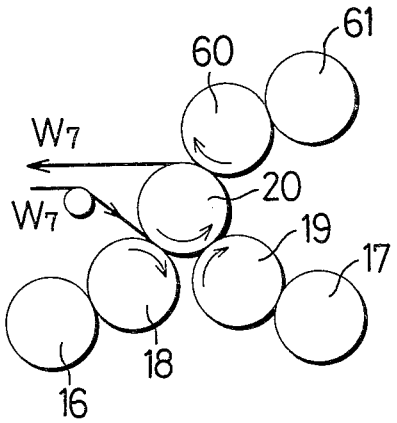

In case of the printing modes which requires an intermediate mode (See FIGS. 4 and 5), the driven gear 41 and the driven disc 39 are made separate, and the pin clutch mechanism which allows the selective engagement of the driven disc 39 with the driven gear 41 and with the prime mover segment gear 42 is effectively used as in the illustrated embodiment.

For the switching from one to the other of the extreme positions, as shown in FIG. 12, the head of the clutch operation rod 52 is rotated in the counter-crockwise direction by a tool. As a result, the male screw rod 52*a* of the operating rod 52, which has been engaged by the female screwed bore 49*a* of the clutch pin 49, is driven out of the bore 49*a*. Thanks to the provision of the rotation prevention pin 57 which engages the pin guide grooves 58 and 59, the clutch pin 49 is not rotated in the bore 47 but slided in the longitudinal direction. The male screw rod 52*a* is withdrawn from the female screwed bore 49*a* in the clutch pin 49, so that the both are separated each other.

However, the front end portion of the male screw rod 52*a* has yet been remained into the bore 48 of the driven disc 39. As shown in FIG. 12, making the sleeve 53 displaced outwards along the female screwed bore of the plate 56, clutch operating rod 52 is displaced outwards too. Thus, the front end portion of the male screw rod 52*a* goes completely away from the bore 48 of the driven disc 39. In this state, the clutch pin is received only by the bore 47 of the driven gear 41 and the bore 48 of the driven disc 39. Once this state has been obtained, the switching of the printing cylinders 18 and 19 between their extreme positions can be achieved as shown in FIGS. 6 and 7, as the pneumatic cylinder 33 is actuated to cause a travel of the piston rod 34 over the full stroke.

In this switching between two extreme positions of the printing cylinders the clutch pin 49, which is received by the insertion bores 47 and 48 of the driven gear 41 and the driven disc 39, takes the angular positions as shown in FIG. 13 and 14. An angular difference of 120° exists between these positions, due to the operation of the geared angle doubling mechanism. However, the prime mover segment gear 42 in the meantime makes an angular displacement which is only a half of the above-mentioned angular difference, i.e. an angular displacement of only 60°. Therefore, one of the clutch pin insertion bore 50, which has aligned in the state of FIG. 6 with the bore 48 of the driven disc 39, is stopped at a mid position as shown in FIG. 7, while the bore 48 of the driven disc 39 in the 120° advanced position comes into alignment with the other clutch pin insertion bore 51 of the prime mover segment gear 42.

Figure 18:
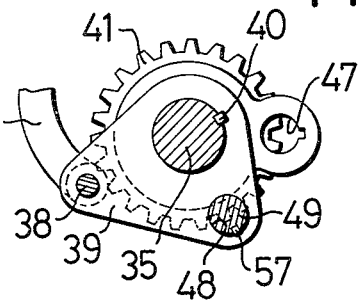
FIG. 18 shows the same positional relationship taken when the impression throw off of the printing cylinders is started from the printing mode as shown in FIG. 7, i.e. the printing mode as shown in FIGS. 14 and 16.

Therefore, for switching the printing cylinders from the extreme position as shown in FIG. 7 to the intermediate mode, the clutch pin actuating mechanism provided on the other clutch pin insertion bore 51 of the prime mover segment gear 42 is operated to shift the clutch pin 49 from the position as shown in FIG. 12 to the position as shown in FIG. 11, out of the bore 47 of the driven gear 41, until the pin comes to be received by the bore 48 of the driven disc 39 and the segment gear 42 to each other. Then, as the rod 34 of the pneumatic cylinder 33 is fully extended from the position as shown in FIG. 7 to the position as shown in FIG. 10, an angular displacement of 60° which is half of the angular displacement between the extreme positions is imparted to the driven disc 39, so as to achieve the state of intermediate mode (See FIGS. 10 and 18).

The resetting from the intermediate mode as shown in FIG. 10 is possible only to the position as shown in FIG. 7, and the direct resetting to the position of FIG. 6 is not allowed.

Figure 17:
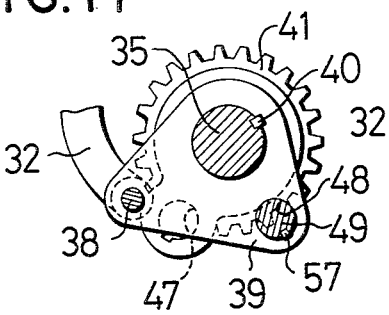

In contact, for causing a shift from the extreme position as shown in FIG. 6 to the intermediate mode, the clutch pin actuating mechanism provided on one clutch pin insertion bore 50 of the segment gear 42 is operated, as shown in FIG. 11, so as to move the clutch pin 49 from the position as shown in FIG. 12 to the position as shown in FIG. 11, thereby to directly couple the driven disc 39 and the segment gear 42 to each other. Then, as the rod 34 of the pneumatic cylinder 33 is retracted by one stroke from the position of FIG. 6 to the position of FIG. 9, an angular displacement which amounts a half of the angular displacement between two extreme positions of 120°, i.e. an angular displacement of 60°, is imparted to the driven disc 39, so as to set the cylinders in the intermediate mode (See FIGS. 9 and 17).

Figure 9:
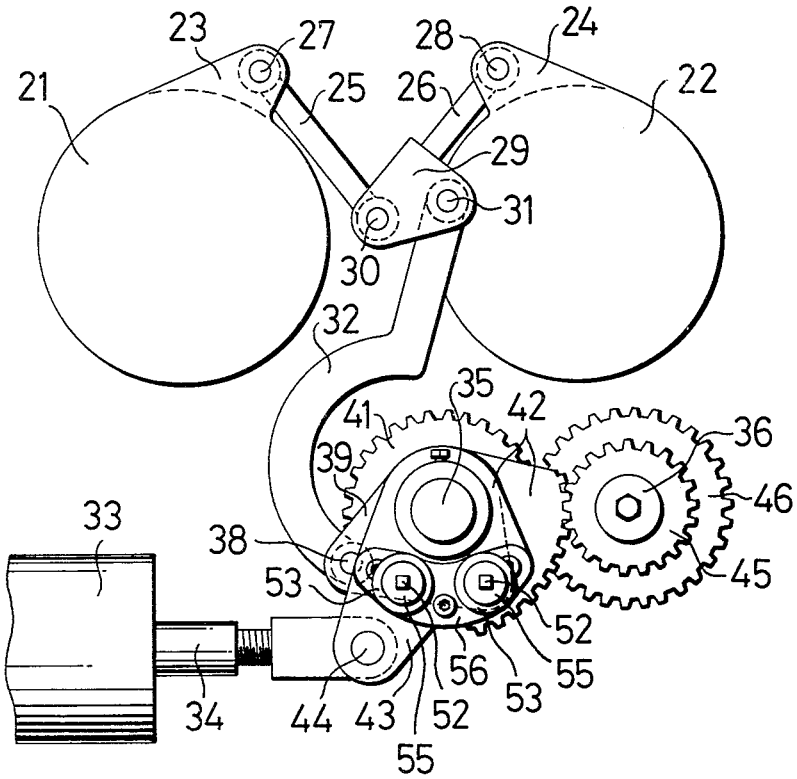
FIG. 9 is an illustration of positional relationship of essential part of the shifting mechanism, in a state in which an impression throw off is made from the states as shown in FIGS. 3, 4 and 6.

The resetting of the cylinders from the intermediate position as shown in FIG. 9 is allowed only to the extreme position as shown in FIG. 6. Thus, the resetting to the extreme position as shown in FIG. 7 from this state is not permitted.

According to the invention, thanks to the use of the angle increase shifting mechanism making use of gears, the large angular displacements of the eccentric sleeves 21 and 22 required for the displacements of a pair of the printing cylinders 18 and 19 can be performed at once by a single stroke of the piston rod 34 of the pneumatic cylinder 33 of a small size, and the switching of the printing cylinders between one and the other extreme positions can be achieved without fail, promptly and easily. Thus, the apparatus of the invention can effectively be used in the switching of printing modes which does not require the intermediate mode.

Further, according to the invention, the angle increase shifting mechanism is suitably combined with a pin clutch mechanism, so that the apparatus of the invention can be applied to the switching of printing modes which requires the intermediate mode. Since the switching to the intermediate mode is effected from respective extreme positions, the cylinders are reset to the positions for the printing mode which is being conducted, safely, promptly and easily, after the completion of the work which requires the impression throw off, contributing greatly to the improvement of the printing work.

What is claimed is:

1. In a mechanism having two plate cylinders and an impression cylinder which are located at positions corresponding to apices of an equilateral triangle, printing cylinders between said impression cylinder and respective plate cylinders, eccentric sleeves attached to the both axial end supports of respective printing cylinders, and a common link mechanism associated with said eccentric sleeves, said common link mechanism being adapted to actuate said eccentric sleeves so as to displace said printing cylinders relatively to each other and to the other of said cylinders, so as to provide two extreme positions of said cylinders, one of said extreme positions in which connection of four of said cylinders except said impression cylinder is attained and the other of said extreme positions in which connection of five of said cylinders is attained, said link mechanism having a starting end, an actuator with a movable rod end, an apparatus for actuating said common link mechanism comprising an angle increase shifting mechanism disposed between the said starting end of said link mechanism and the said rod end, said angle increase shifting mechanism including a main shaft and a sub shaft mounted on a frame, a driving gear adapted to follow the displacement of said rod of said actuator, a driven gear adapted to transmit a displacement, to said starting end of said link mechanism, said driving and driven gears being mounted on said main shaft, and relay gears unitary with each other and having different diameters, said relay gears being in engagement with respective one of said driving and driven gears and mounted on said sub shaft, whereby the switching from one extreme position to other is performed by a single motion of said rod.

2. In a mechanism having two plate cylinders and an impression cylinder which are located at positions corresponding to apices of an equilateral triangle, printing cylinders between said impression cylinder and respective plate cylinders, eccentric sleeves attached to the both axial end supports of respective printing cylinders, and a common link mechanism associated with said eccentric sleeves, said common link mechanism being adapted to actuate said eccentric sleeves so as to displace said printing cylinders relatively to each other and to the other of said cylinders, so as to provide two extreme positions of said cylinders, one of said extreme positions in which connected of four of said cylinders except said impression cylinder is attained and the other of said extreme positions in which connection of five of said cylinders is attained, said link mechanism having a starting end, an actuator with a movable rod end, an apparatus for actuating said common link mechanism comprising an angle increase shifting mechanism disposed between the said starting end of said link mechanism and the said rod end, said angle increase shifting mechanism including a main shaft and a sub shaft mounted on a frame, a driving gear adapted to follow the displacement of said rod of said actuator, a driven gear adapted to transmit a displacement to said starting end of said link mechanism, said driving and driven gears being mounted on said main shaft, and relay gears unitary with each other and having different diameters, said relay gears being in engagement with respective one of said driving and driven gears and mounted on said sub shaft, said switching apparatus further comprising a pin clutch mechanism including a driven disc disposed between said driven gear and said starting end of said link mechanism, coaxially with said driven gear and connected to said starting end of said link mechanism, said driven gear and said driven disc having clutch pin insertion bores for receiving a clutch pin for connecting said driven gear and driven disc unitarily with each other, said driving gear having clutch pin insertion bores formed at two portions thereof aligning with said clutch pin insertion bore of said driven disc when the laatter exists at said first and second extreme positions, and a clutch pin actuating mechanism disposed at respective ends of said clutch pin insertion bores of said driving gear, said clutch pin actuating mechanism being adapted to longitudinally shift said clutch pin for two kinds of engagement, one kind of engagement being between said driven disc and said driven gear and the other kind of engagement being between said driven disc and said driving gear, whereby not only the switching between extreme positions is completed in one motion of said rod or, but also, as required, the branching of an intermediate mode, with impression throw off of the printing cylinders, from each extreme position.

3. A switching apparatus between printing modes in printing cylinders of a rotary press as claimed in claim 2, wherein said clutch pin actuating mechanism includes means for preventing said clutch pin from rotating in said bores, a clutch operation rod adapted to be inserted into the bore in which said clutch pin is inserted, and a male screw rod attached to the end of said clutch operation rod and adapted to engage a female screwed bore formed from one end of said clutch pin in the axial direction of the latter, whereby a longitudinal displacement of said clutch pin in said bores is caused by the screwing engagement of said male screw rod and said female screwed bore.

* * * * *